US007102466B2

(12) United States Patent
Chang et al.

(10) Patent No.: US 7,102,466 B2
(45) Date of Patent: Sep. 5, 2006

(54) METHOD OF REDUCING SWITCHING NOISE IN A POWER DISTRIBUTION SYSTEM BY EXTERNAL COUPLED RESISTIVE TERMINATORS

(75) Inventors: Tsun-hsu Chang, Hsinchu (TW); Chun-cheng Chen, Hsinchu (TW)

(73) Assignee: Silicon Integrated Systems Corp., (TW)

( * ) Notice: Subject to any disclaimer, the term of this patent is extended or adjusted under 35 U.S.C. 154(b) by 0 days.

(21) Appl. No.: 10/377,676

(22) Filed: Feb. 28, 2003

(65) Prior Publication Data

US 2004/0169571 A1 Sep. 2, 2004

(51) Int. Cl.
*H01P 7/08* (2006.01)

(52) U.S. Cl. ..... 333/181; 333/291

(58) Field of Classification Search ..... 333/203, 333/204, 219, 181, 185
See application file for complete search history.

(56) References Cited

U.S. PATENT DOCUMENTS 4,333,062 A * 6/1982 Uwano ..... 331/99

FOREIGN PATENT DOCUMENTS

JP 402193401 * 7/1990
JP 02001156506 * 6/2001

* cited by examiner

*Primary Examiner*—Dinh T. Le
(74) *Attorney, Agent, or Firm*—Martine Penilla & Gencarella, LLP

(57) ABSTRACT

Voltage fluctuations, especially due to a resonant effect of a power distribution system, result in serious timing skews in a high-speed digital system. Adding extra resistive loadings for coupling out the noise into external terminations will reduce a quality factor of the power distribution system, which will effectively minimize the noise accumulation. The external coupled resistive terminators are preferably formed on positions of a microstrip resonator where relatively high noise fluctuations occur. Each of the external coupled resistive terminators may be formed of a resistor, a transmission line with a resistor at one end, a lossy transmission line with an open circuit at one end, or a quarter-wavelength lossy transmission line. Simulation results indicate that the maximum voltage fluctuations are suppressed from 750 mV to 150 mV at a resonant frequency and about 50% for an overall range of the operating frequencies.

16 Claims, 9 Drawing Sheets

METHOD OF REDUCING SWITCHING NOISE IN A POWER DISTRIBUTION SYSTEM BY EXTERNAL COUPLED RESISTIVE TERMINATORS

BACKGROUND OF THE INVENTION

1. Field of the Invention

The present invention generally relates to a power distribution system and, more particularly, to a method of reducing switching noise in a power distribution system by external coupled resistive terminators.

2. Description of the Related Art

Precisely controlling timing skew is one of major challenges in high-speed digital signaling. Among various reasons that cause the timing skew, power integrity is recently considered to be a principal concern, especially under a requirement of high throughput and low voltage swing. Switching noise is a dominant noise source in a power distribution system. Minimizing this noise will be beneficial to overall power integrity.

When an I/O buffer is switched, it will not only draw energy from the power distribution system in a very short period of time, but also induce a broadband noise onto the power distribution system. The noise level is exacerbated even further when multiple signals make transitions at the same time, which is referred to as simultaneously switching noises. These simultaneously switching noises are basically in phase or nearly in phase and therefore their noise amplitudes can be accumulated, instead of being cancelled. If designed improperly, power/ground planes of the power distribution system form a resonator such that the noise with a frequency closer to a certain resonant frequency can be stored up, causing more severe problems to the power integrity.

One of the most common and greatly accepted solutions to suppressing the noise is placing decoupling capacitors on to the power distribution system; however, equivalent series inductances of wirings used to connect between the decoupling capacitors and the power distribution system limits a possible application to a high frequency regime.

Alternatively, lowing the resonant effect can effectively alleviate the noise accumulation since the noise is more violent upon resonance. The resonance effect on the noise can be avoided by detuning the resonant frequency from an operating frequency or adding more loss to reduce a quality factor of the power distribution system. For example, noise absorption materials are provided at edges of a circuit board to effectively minimize reflection and radiation due to edge discontinuity, especially at a high frequency regime. This method is referred to as "edge termination." Two types of noise absorption materials have been proposed, i.e. electric and magnetic lossy materials. However, in the case of the electric lossy materials, an undesired leakage current is induced and, in the case of the magnetic lossy materials, it is impossible to achieve a broadband absorption due to a lack of appropriate magnetic lossy materials.

SUMMARY OF THE INVENTION

In view of the above-mentioned problems, an object of the present invention is to provide a method of reducing switching noise in a power distribution system by external coupled resistive terminators.

According to an aspect of the present invention, a method of reducing switching noise in a power distribution system is provided for coupling the switching noise out of the distribution system into dissipative heat. The switching noise is coupled out from the resonator of the power distribution system and terminated with external coupled resistive terminators. The external coupled resistive terminators are preferably installed on positions where relatively high noise fluctuations occur. Each of the external coupled resistive terminators may be formed of a resistor, a transmission line with a resistor at one end, a lossy transmission line with an open circuit at one end, a quarter-wavelength lossy transmission line, or a combination thereof.

A Y-shaped microstrip resonator is investigated as an example. The Y-shape microstrip resonator has a central stem and two wings connected to one end of the central stem. To investigate frequency responses of the power distribution system, a voltage control resistor buffer model is preferably used for modeling each of the I/O buffers. Simulation results indicate that the maximum voltage fluctuations are suppressed from 750 mV down to 150 mV at a resonant frequency and about 50% for an overall range of the operating frequencies.

The method according to present invention is useful in reducing switching noise in the power distribution system and should be incorporated into circuit design consideration. Although only the Y-shaped microstrip resonator is demonstrated in the specification, the present invention is applicable to much more complicated power/ground layouts.

BRIEF DESCRIPTION OF THE DRAWINGS

The above-mentioned and other objects, features, and advantages of the present invention will become apparent with reference to the following descriptions and accompanying drawings, wherein.

DETAILED DESCRIPTION OF THE PREFERRED EMBODIMENTS

The preferred embodiments according to the present invention will be described in detail with reference to the drawings.

A power/ground layout of a power distribution system is generally manifold and adaptable. It will be beneficial to extract some generic characteristics so as to formulate a guideline for the layout engineer. Hereinafter, a Y-shaped microstrip resonator is employed as part of a power layer for demonstrating a method of reducing switching noise according to the present invention.

Figure 1:
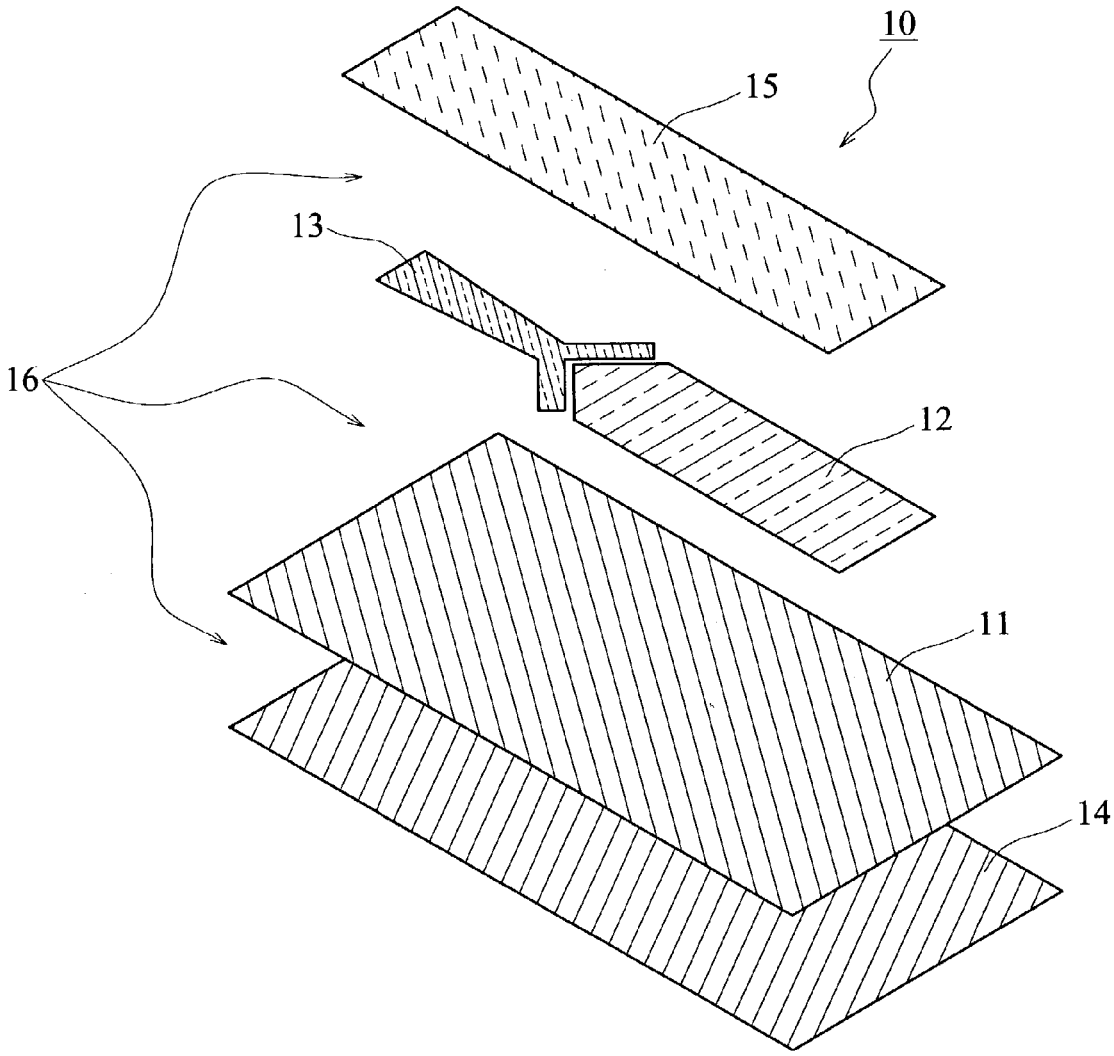
FIG. 1 is a perspective view showing an example of a configuration of a power distribution system.

FIG. 1 is a perspective view showing an example of a configuration of a power distribution system 10. Referring to FIG. 1, the power distribution system 10 includes a first ground layer 11, a second ground layer 12, and a Y-shaped microstrip resonator 13. The second ground layer 12 and the Y-shaped microstrip resonator 13 are located on a common horizontal plane and electrically insulated from each other. The first ground layer 11 is separated from the Y-shaped microstrip resonator 13 by a distance of 44 mils. The first and second ground layers 11 and 12 are to provide voltage grounds while the Y-shaped microstrip resonator 13 is connected to an external power supply (not shown) for distributing power throughout the power distribution system. The first and second ground layers 11 and 12 and the Y-shaped microstrip resonator 13 may be formed of copper or other conductive materials. Each of the first and second ground layers 11 and 12 has a thickness of 1.4 mils while the Y-shaped microstrip resonator 13 has a thickness of 1.4 mils.

A first signal line plane 14 is arranged under the first ground layer 11 by a distance of 4 mils. A plurality of signal lines (not shown) formed of copper or other conductive materials may be provided on the first signal line plane 14. Similarly, a second signal line plane 15 is arranged above the common horizontal plane, on which the second ground layer 12 and the Y-shaped microstrip resonator 13 are located, by a distance of 4 mils. A plurality of signal lines (not shown) formed of copper or other conductive materials may be provided on the second signal line plane 15.

In order to provide necessary electrical insulation, an insulating material 16 is interposed into the space between the first ground layer 11 and the common horizontal plane of the second ground layer 12 and the Y-shaped microstrip resonator 13, between the first ground layer 11 and the first signal line plane 14, and between the common horizontal plane of the second ground layer 12 and the Y-shaped microstrip resonator 13 and the second signal line plane 15. For example, the insulating material 16 may be formed of epoxy-resin-fiber glass (FR4) or dielectric materials. The signal lines on the first and second signal line planes 14 and 15 may be connected to the first and second ground layer 11 and 12 or the Y-shaped microstrip resonator 13 through conductive vias (not shown) penetrating the insulating material 16.

Figure 2:
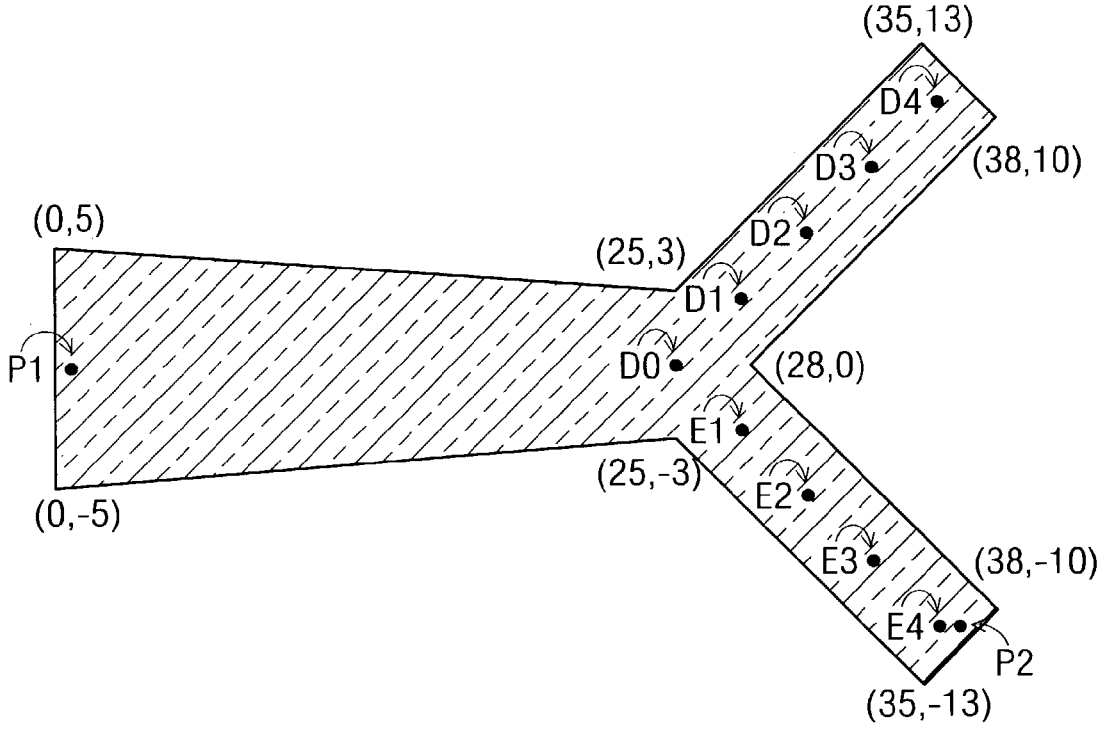
FIG. 2 is a plane view showing a Y-shaped microstrip resonator of FIG. 1.

FIG. 2 is a plane view showing the Y-shaped microstrip resonator 13 of FIG. 1. Referring to FIG. 2, the Y-shaped microstrip resonator 13 is marked on each of turning points with a set of numbers indicating corresponding abscissa and ordinate coordinates in a unit of mm, respectively. Positions of I/O buffers are denoted by symbols D0 to D4. Positions of detecting points are denoted by symbols P1 to P2. Positions of external coupled resistive terminators according to the present invention are denoted by symbols E1 to E4. Each of the external coupled resistive terminators may be formed of a resistor, a transmission line with a resistor at one end, a lossy transmission line with an open circuit at one end, a quarter-wavelength lossy transmission line, or a combination thereof. The voltage fluctuation (or noise) of the Y-shaped microstrip resonator 13 is detected with a high impedance probe in order not to interfere the power distribution system 10. Each of the I/O buffers D0 to D4 drives output signals along the signal lines of the second signal line planes 15 with reference to the second ground plane 12. Likewise, each of the external coupled resistive terminators E1 to E4 leads the voltage fluctuation (or noise), excited due to the switching of the I/O buffers D0 to D4, out of the power distribution system 10 and terminates the voltage fluctuation therewith. To avoid influence of multiple reflections, all of the signal lines are well terminated.

To investigate frequency responses of the power distribution system 10, a voltage control resistor (VCR) buffer model is preferably used for modeling each of the I/O buffers D0 to D4. The impedance value of the linear-behavior (or piecewise) VCR buffer model during the switching period is variable and depends on a voltage of an operating signal. In the following simulations, an operating signal to be supplied to each of the I/O buffers D0 to D4 has a trapezoidal waveform with a rise/fall time of 200 ps. Regardless of a frequency of the operating signal, the rise/fall time of the operating signal remains at 200 ps. Since the operating signal to be supplied to each of the I/O buffers D0 to D4 is not sinusoidal, a frequency sweep range of the operating signal covers several harmonics where the bandwidth is correlated to the rise/time of the operating signal.

The quality factor of a resonant system indicates the strength of the resonant effect and influential bandwidth. Reducing the quality factor can effectively alleviate the resonant effect. The quality factor of a resonant system is inversely proportional to the power dissipation of a resonant system. The unloaded quality factor $Q_U$ of a resonant system can be expressed as follows, $$Q_U = \frac{2\omega W_e}{P_d + P_c} \tag{1}$$

where ω is a resonant frequency, $W_e$ is a total electric field energy, and $P_d$ and $P_c$ are dielectric and conductor power losses, respectively. For a resonant frequency of a few hundreds MHz, the dominant loss mechanism is the conductor loss. However, this intrinsic loss is not enough for obtaining a sufficiently low quality factor. Therefore, it is necessary to provide an extra loss mechanism. The desirable extra loss mechanism can be achieved by properly placing a plurality of external coupled resistive terminators in the power distribution system 10. As a result, the loaded quality factor $Q_L$ becomes:

$$Q_L = \frac{2\omega W_e}{P_d + P_c + P_e} = \left(\frac{P_d + P_c}{P_d + P_c + P_e}\right) Q_U \tag{2}$$

where $P_e$ is an external power loss.

Figure 3A:
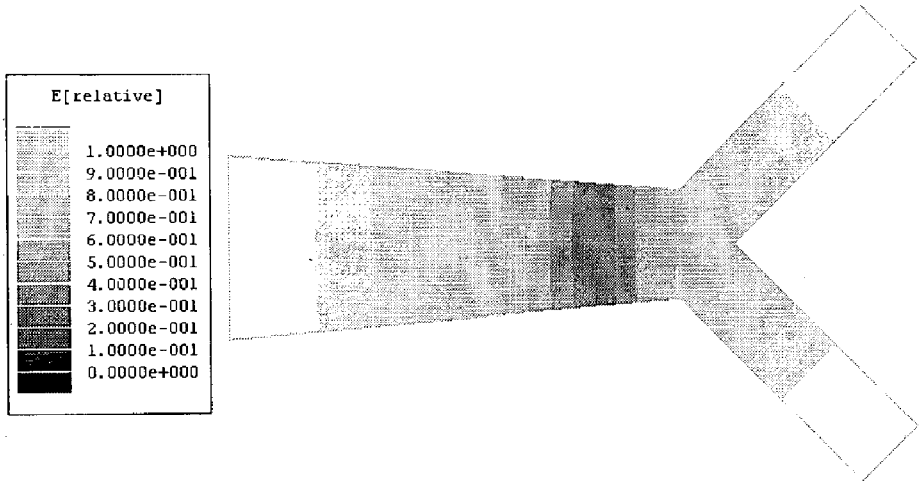
FIGS. 3*a* and 3*b* are diagrams showing electric field patterns of first two resonant modes of a Y-shaped microstrip resonator.
Figure 3B:
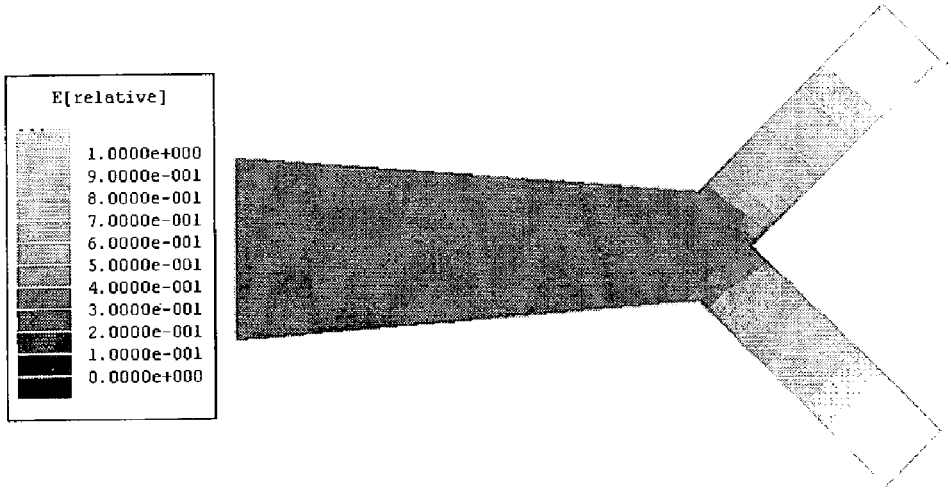

FIGS. 3*a* and 3*b* are diagrams showing electric field patterns of first two resonant modes of the Y-shaped microstrip resonator 13. It should be noted that the simulated results of FIGS. 3*a* and 3*b* are obtained from a bare-board configuration consisting of the power and ground layers only. In FIG. 3*a*, a fundamental mode with the lowest resonant frequency of 1.632 GHz has a field maximum at a central stem and the field variations at two wings are in phase all the time. However, for the first high order mode shown in FIG. 3*b*, with a resonant frequency of 2.347 GHz, the field variations at the two wings are completely out of phase, resulting in the field cancellation at the central stem. These unique field patterns are further explored in FIGS. 4*a* and 4*b*.

Figure 4A:
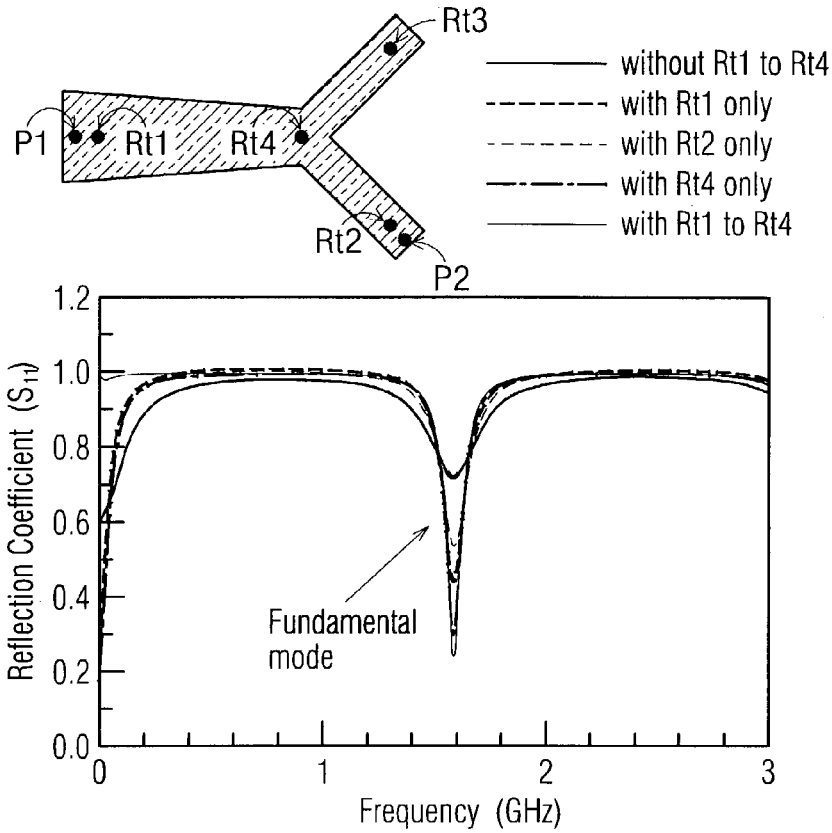
FIGS. 4*a* and 4*b* are graphs showing reflection coefficients of a Y-shaped microstrip resonator with external coupled resistive terminators arranged at different positions Rt1 to Rt4 detected at detecting point P1 and P2, respectively.
Figure 4B:
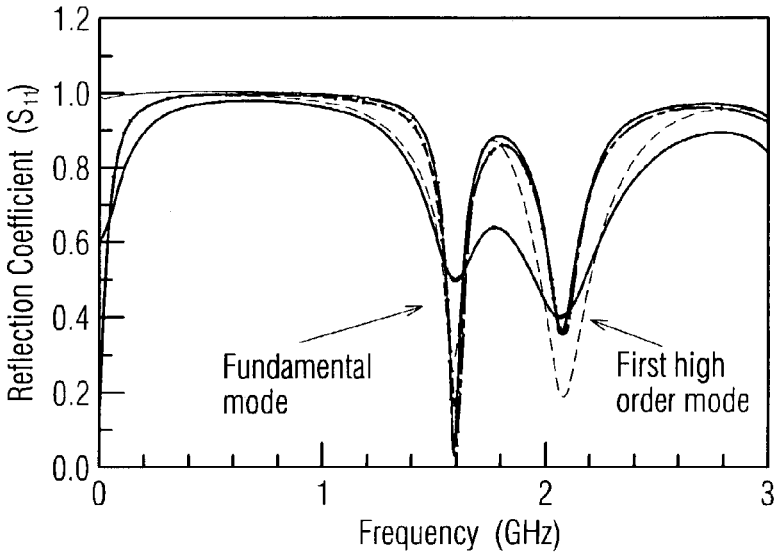

FIGS. 4*a* and 4*b* are graphs showing reflection coefficients of the Y-shaped microstrip resonator 13 with external coupled resistive terminators arranged at different positions Rt1 to Rt4. When probing is performed at the detecting point P1, the first high order mode is not observable due to zero field at the detecting point P1, as shown in FIG. 4*a*. On the contrary, when probing is performed at detecting point P2, both of the fundamental and first high order modes are observable, as shown in FIG. 4*b*. From the reflection coefficients of FIGS. 4*a* and 4*b*, the quality factors of the Y-shaped microstrip resonator 13 can be obtained readily. According to FIGS. 4*a* and 4*b*, for the fundamental mode, the Y-shaped microstrip resonator 13 without any of the external coupled resistive terminators Rt1 to Rt4 has the highest quality (Q=30) while the Y-shaped microstrip resonator 13 with all of the external coupled resistive terminators Rt1 to Rt4 has the lowest quality factor (Q=5).

In the case of the noise pattern of the fundamental mode, the external coupled resistive terminators Rt1, Rt2, and Rt3 are arranged at the field maximum whereas the external coupled resistive terminator Rt4 is arranged at a relatively low field. Since the fields at both wings are in phase, the external coupled resistive terminators Rt2 and Rt3 have the same effect. The simulation results exhibit the same trend. When the external coupled resistive terminator Rt2 is employed, the highest quality factor reduction is obtained in comparison with Rt1 and Rt4. The reason why the external coupled resistive terminator Rt1 is less effective than the external coupled resistive terminator Rt2 is that the electric field is relatively divergent in the central stem.

In the case of the noise pattern of the first high order mode, the quality factor is preferably detected at detecting point P2 due to the intrinsic field distribution. The quality factor variation of the first high order mode exhibits the same trend as the fundamental mode. That is, arranging the external coupled resistive terminators at the field maximum of the power distribution system will significantly reduce the quality factor. This generic property suggests that it will be advantageous for the power integrity of the power distribution system to couple out the noise at the field maximum of a target mode and dissipate it with the external coupled resistive terminators.

A real-world power distribution system consists of several power/ground planes, I/O buffer circuits, voltage supply circuits, connecting vias, traces, and lumped components and therefore exhibits much more complicated properties than a bare-board configuration shown in FIGS. 3*a*, 3*b*, 4*a*, and 4*b*. A sufficiently long simulation time of 30 ns is used for the transient simulation. For a practical interest, only maximum voltage fluctuations, i.e. the worst cases, corresponding to individual operating frequencies are recorded and analyzed.

The frequency responses of the power distribution system are simulated by using the VCR buffer model. This linear-behavior (or piecewise) VCR buffer model is extracted from the IBIS model of a SiS 648 chipset that can operate at DDR (Double Data Rate Synchronous) 400 MHz. The waveform is basically trapezoidal with a rise/fall time of 200 ps. Considering the rapid technology evolution and validity of frequency spectrum, the frequency sweep up to 1.6 GHz is preferable.

Figure 5A:
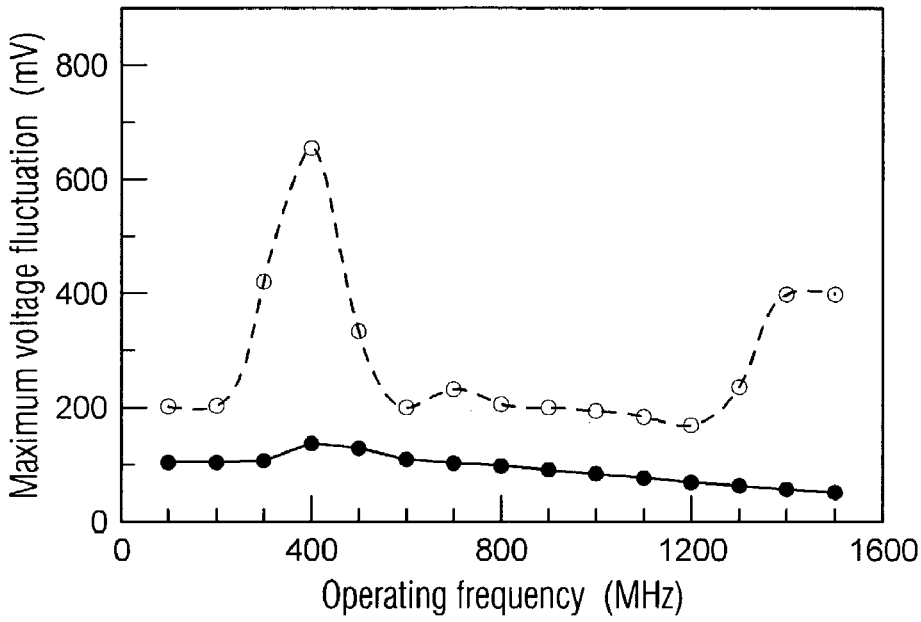
FIGS. 5*a* and 5*b* are graphs showing maximum voltage fluctuations detected at a detecting point P1 of FIG. 2 in cases of a single I/O buffer D0 and multiple I/O buffers D0 to D4, respectively.
Figure 5B:
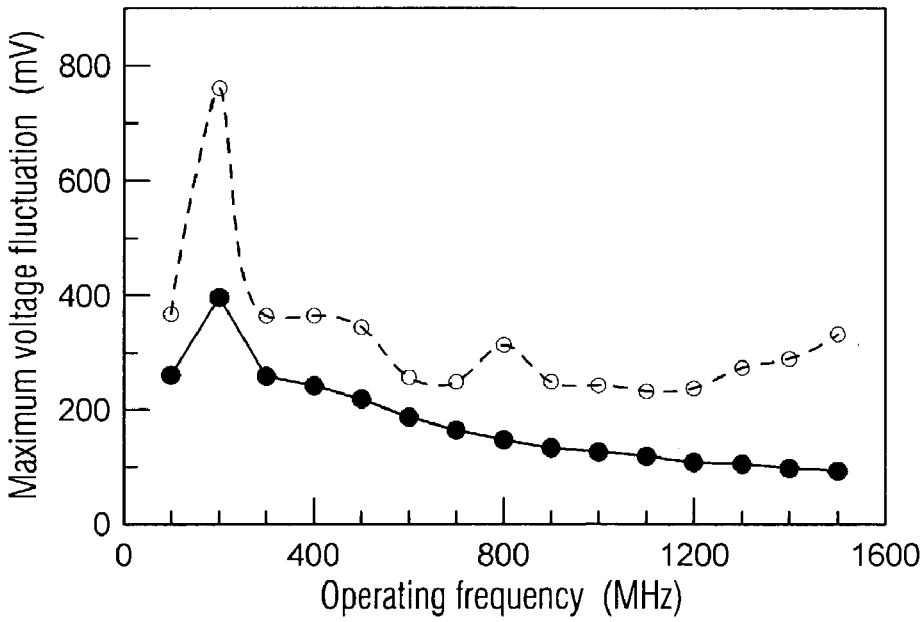

FIGS. 5*a* and 5*b* are graphs showing maximum voltage fluctuations detected at the detecting point P1 of FIG. 2 when a single I/0 buffer D0 switches and multiple I/0 buffers D0 to D4 switches, respectively. In FIGS. 5*a* and 5*b*, dashed lines with hollow circles represent original noise voltage fluctuations in response to operating frequencies whereas solid lines with solid circles depict suppressed noise levels when the external coupled resistive terminators E1 to E4 shown in FIG. 2 are employed.

As can be clearly seen from FIGS. 5*a* and 5*b*, peaks of the maximum voltage fluctuations in response to the operating frequencies are around 400 MHz and 200 MHz, respectively. These values are different from the simulation results of the bare-board configuration shown in FIGS. 4*a* and 4*b* because the additional circuits have modified the power distribution system.

When the multiple I/0 buffers D0 to D4 switches simultaneously, the overall noise level is higher than that caused by the switching of the single I/O buffer D0, but their relation is not a simply multiplication. This implies that the noises generated by each of the noise sources, i.e. I/0 buffers D0 to D4, are not always in phase with each other. The total noises might diminish due to a certain level cancellation. This suggests that the worst case might not come from the simultaneous switching of all of the I/O buffers D0 to D4, but come from their noises are in phase or, more precisely, synchronous.

As shown in FIG. 5*a*, a pretty good performance on the noise suppression is achieved, especially at the resonant frequency where the noise is significantly suppressed from 750 mV down to 150 mV. As shown in FIG. 5*b*, the external coupled resistive terminators E1 to E4 according to the present invention are still effective in suppressing the noises in the case of the multiple I/O buffers D0 to D4, but not as significant as in the case of the single I/O buffer D0. This is because the noise patterns in both of the cases are different. In the single I/O buffer case, the whole power distribution system is more like a bare broad, thus excitation of single resonant mode can be achieved. However, when the multiple I/O buffers arranged at different positions switch simultaneously, much more complicated resonant modes might occur, resulting in less effective on the noise suppression. This implies that the higher resonant mode purity, the better the noise suppression.

Figure 6A:
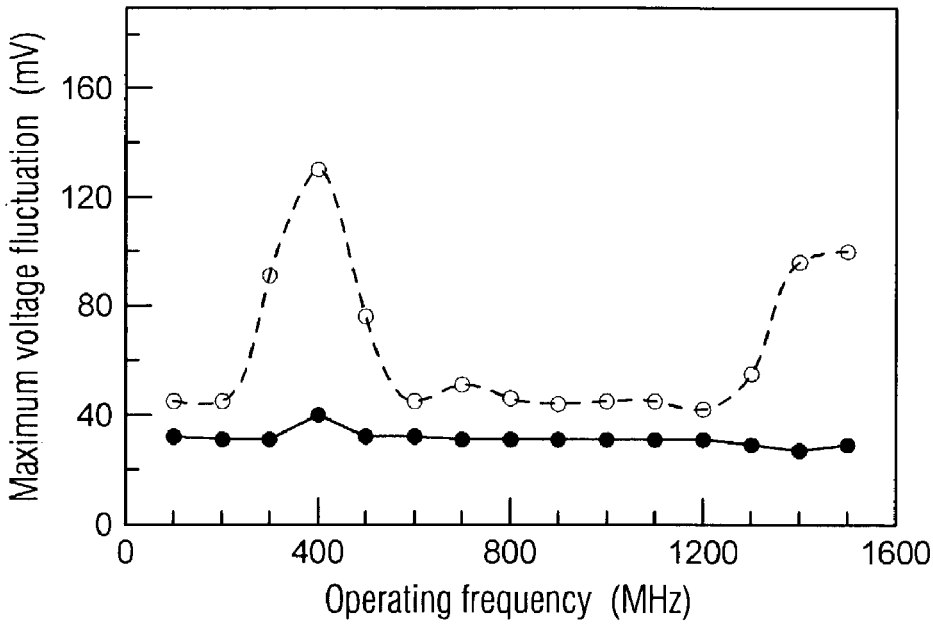
FIGS. 6*a* and 6*b* are graphs showing maximum voltage fluctuations detected at a detecting point P2 of FIG. 2 in cases of a single I/O buffer D0 and multiple I/O buffers D0 to D4, respectively.
Figure 6B:
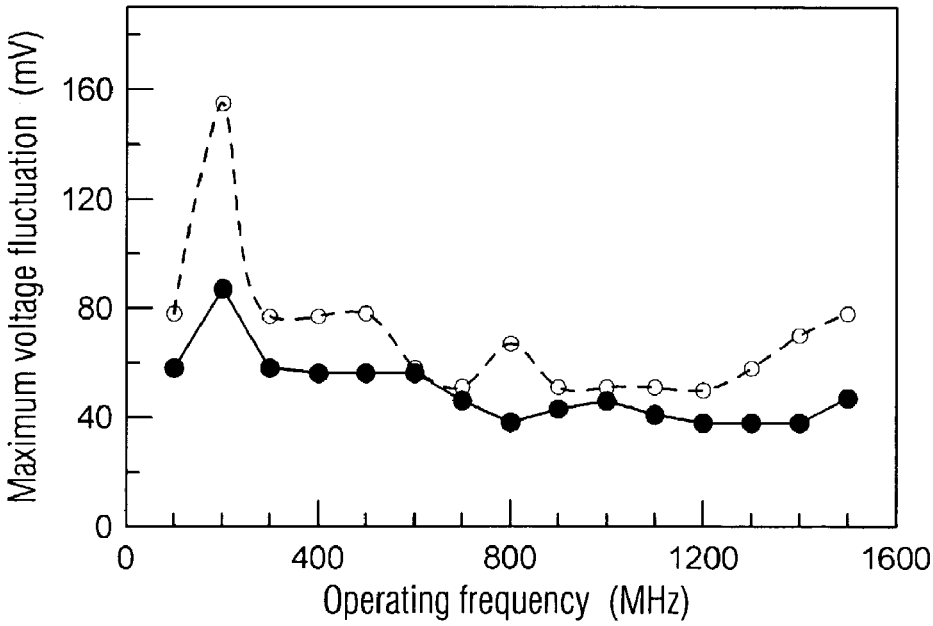

FIGS. 6*a* and 6*b* are graphs showing maximum voltage fluctuations detected at the detecting point P2 of FIG. 2 in cases of a single I/O buffer D0 and multiple I/O buffers D0 to D4, respectively. All of the parameters and settings are the same as their counterparts in FIGS. 5*a* and 5*b* except the detecting points. As can be clearly seen from FIG. 6*a*, a pretty good noise suppression is achieved for the case of the single I/O buffer D0. As can be clearly seen from FIG. 6*b*, a fair noise suppression is achieved for the case of multiple I/O buffers D0 to D4.

The absolute noise levels are dramatically different when probed at the detecting points P2 and P1 although their noise suppression ratios are similar to each other. The detecting point P1 has lower maximum voltage fluctuations than the detecting point P2 for two reasons. The first one is that the detecting point P1 is closer to the power supply, resulting in that the detected voltages look like bound to a fixed boundary, instead of an open boundary condition. Another reason is that the noise, once excited, radiates to the surrounding environment in the transient state. Because the width of the Y-shaped microstrip resonator at the detecting point P1 is wider than that at the detecting point P2, the Y-shaped microstrip resonator has a larger effective capacitance at the detecting point P1, resulting in much lower maximum voltage fluctuations.

In our present analysis, only the maximum voltage fluctuations are discussed. The maximum voltage fluctuations frequently happen when the power distribution system is still in the transient state. In such a condition, the noise field pattern does not converge to a certain pattern. Instead, the noise is scattered throughput the Y-shaped microstrip resonator.

Figure 7A:
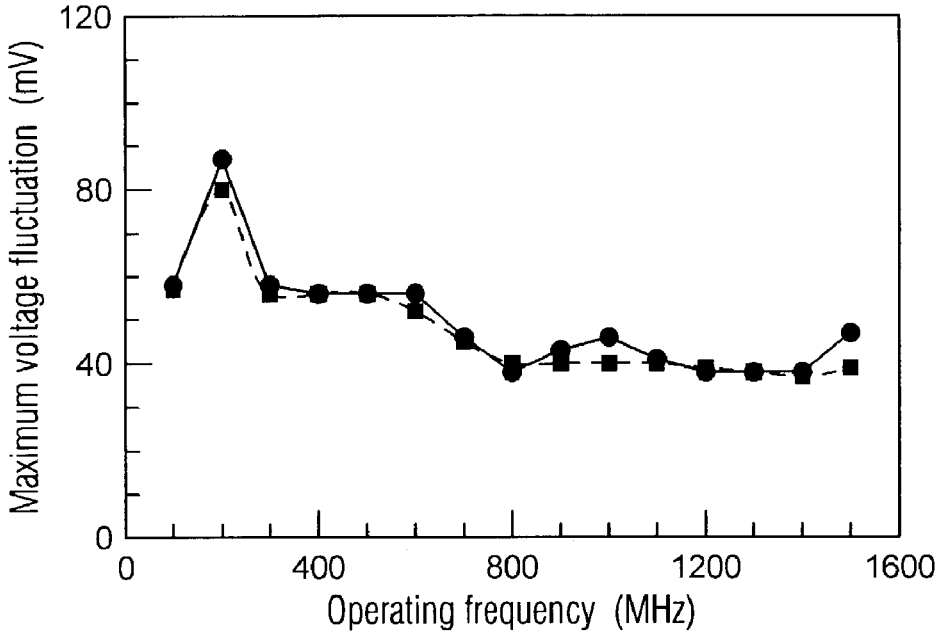
FIGS. 7*a* and 7*b* are graphs showing maximum voltage fluctuations detected at the detecting points P1 and P2 of FIG. 2, respectively.
Figure 7B:
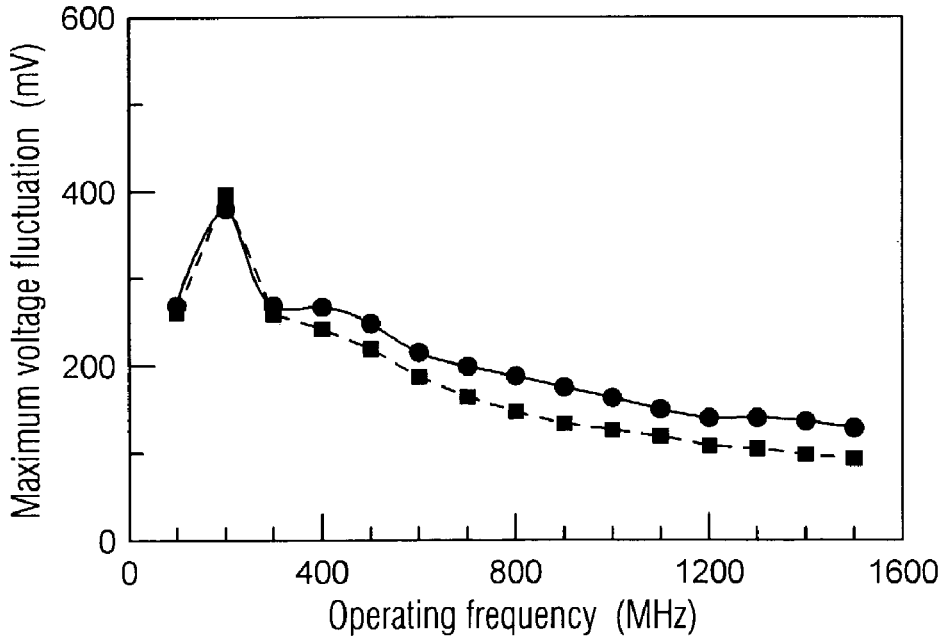

FIGS. 7*a* and 7*b* are graphs showing maximum voltage fluctuations detected at the detecting points P1 and P2 of FIG. 2, respectively. The multiple I/O buffers D0 to D4 are employed in the simulations of FIGS. 7*a* and 7*b*. Referring to FIGS. 7*a* and 7*b*, solid lines with circles indicate a case where four external coupled resistive terminators E1 to E4 shown in FIG. 2 are arranged at one wing of the Y-shaped microstrip resonator 13. On the other hand, dashed lines with squares indicate a case where four external coupled resistive terminators Rt1 to Rt4 shown in FIG. 4*a* are arranged throughout the Y-shaped microstrip resonator 13. As can be clearly seen from FIGS. 7*a* and 7*b*, the more divergent arrangement of the external coupled resistive terminators, i.e., Rt1 to Rt4, enhances the reduction of the maximum voltage fluctuations only to a slight extent because the voltage fluctuations are mainly concentrated on both of the wings.

To sum up, a quality factor of a power distribution system is effectively reduced by arranging an external coupled resistive terminator at the corresponding field maximum of the resonant field pattern. Reasons behind this could be attributed to the distortion of the resonant field pattern at the transient state during the noise accumulation. The method according to the present invention significantly suppresses the maximum voltage fluctuations (i.e., noise) associated with resonant modes of a power distribution system. The simulation results indicate that the maximum voltage fluctuations are suppressed from 750 mV down to 150 mV at the resonant frequency and about 50% for the overall range of the operating frequencies. Furthermore, it is suggested that the higher the resonant mode purity, the easier the resonant mode can be coupled out of the power distribution system by the external coupled resistive terminators.

Figure 8A:
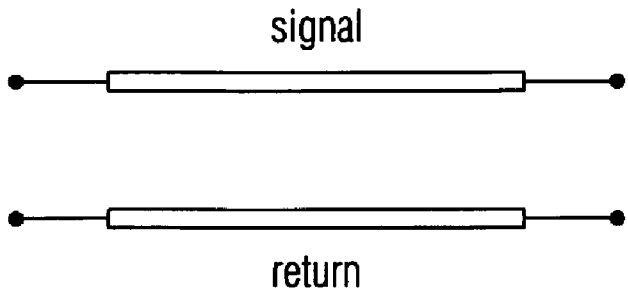
FIGS. 8(*a*)–8(*c*) define example transmission lines.
Figure 8B:
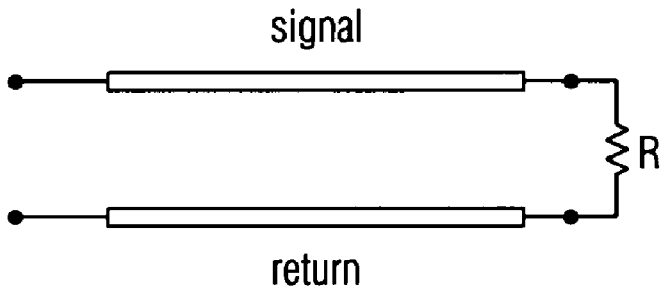
Figure 8C:
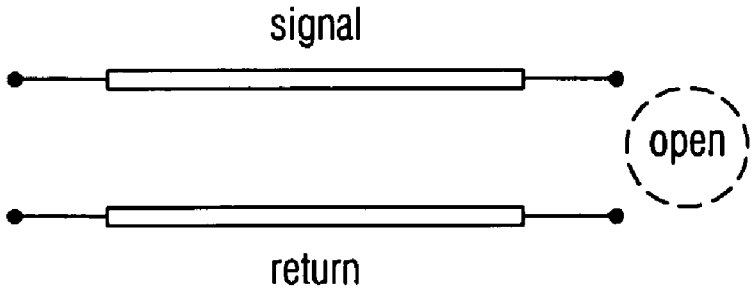

FIGS. 8*a*, 8*b*, 8*c* show a quarter-wavelength lossy transmission line, a lossy transmission line with an open circuit, and a transmission line with a resistor.

Figure 9:
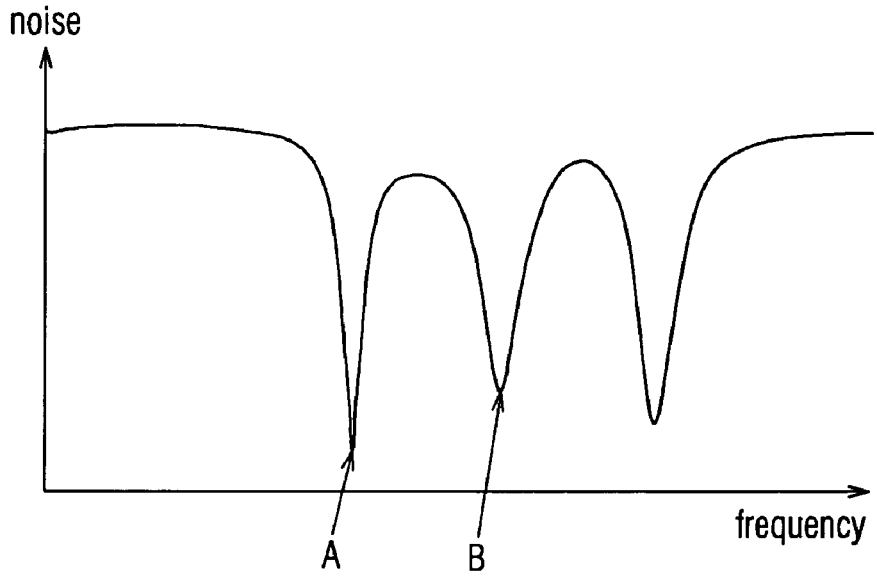
FIG. 9 provides a schematic diagram.

FIG. 9 illustrates a schematic diagram showing relationships between noise and frequency on a microstrip resonator.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

We claim:

1. In a power distribution system including a microstrip resonator having a central stem that extends into two wings, where an external power supply is connected to the central stem that is opposite the two wings, a method of coupling out switching noise in the power distribution system, comprising:

investigating a frequency response at certain points along the microstrip resonator when connected to the external power supply;

identifying a fundamental mode point and other high order mode points where high noise fluctuation occurs along the microstrip resonator based on the investigated frequency response; and defining at least one external coupled resistive terminator so as to connect to at least one of the fundamental mode point or other high order mode points of the at least one microstrip resonator, and an I/O buffer, capable of switching from high to low, being connected to the at least one external coupled resistive terminator, wherein noise from the switching of the I/O buffer is coupled out from the microstrip resonator of the power distribution system by way of the at least one external coupled resistive terminator.

2. The method according to claim 1, wherein each of the at least one external coupled resistive terminator is formed of a resistor.

3. The method according to claim 1, wherein each of the at least one external coupled resistive terminator is formed of a transmission line with a resistor at one end of the transmission line.

4. The method according to claim 1, wherein each of the at least one external coupled resistive terminator is formed of a lossy transmission line with an open circuit at one end of the lossy transmission line.

5. The method according to claim 1, wherein each of the at least one external coupled resistive terminator is formed of a quarter-wavelength lossy transmission line.

6. The method according to claim 1, wherein the at least one microstrip resonator is formed of a Y-shaped.

7. The method according to claim 1, wherein the at least one microstrip resonator is part of a power layer for distributing power throughout the power distribution system.

8. A method of reducing switching noise from switching devices in a power distribution system which distributes power from an external power source to the switching devices, the power distribution system having a substantially Y shaped microstrip resonator and the method comprising:

locating a fundamental point and high order points along the substantially Y-shaped microstrip resonator where high fluctuation of the switching noise occurs; and connecting at least one external resistive terminator to the fundamental point and the high order points to suppress accumulation of the switching noise.

9. The method of claim 8, wherein each of the at least one external resistive terminator is defined as a resistor.

10. The method of claim 8, wherein each of the at least one external resistive terminator is formed from a transmission line with a resistor at an end of the transmission line.

11. The method of claim 8, wherein each of the at least one external resistive terminator is formed from a lossy transmission line with an open circuit at an end of the lossy transmission line.

12. The method of claim 8, wherein each of the at least one external resistive terminator is formed from a quarter-wavelength lossy transmission line.

13. The method of claim 8, wherein the substantially Y-shaped microstrip resonator is part of a power layer for distributing power throughout a power distribution system.

14. A method of reducing switching noise from switching devices in a power distribution system which distributes power from an external power source to the switching devices, comprising:

the power distribution system including a microstrip resonator having a first end that extends to a second end, the first end configured to be connected to the external power source;

locating one of a fundamental point and high order points along the microstrip resonator, the fundamental point and the high order points defining where high fluctuation of the switching noise occurs; and connecting an resistive terminator to at least one of the fundamental point or the high order points, the fundamental point and the high order points being defined on the microstrip resonator in locations between the first end and the second end, the resistor terminator acting to suppress accumulation of the switching noise.

15. The method of claim 14, wherein the resistive terminator is formed as one of (a) a resistor, (b) a transmission line with a resistor at an end of the transmission line; (c) a lossy transmission line with an open circuit at an end of the lossy transmission line; or (d) a quarter-wavelength lossy transmission line.

16. The method of claim 14, wherein the microstrip resonator is part of a power layer for distributing power throughout a power distribution system.

* * * * *